US005813783A

United States Patent [19]

Takatori

[11] Patent Number: 5,813,783

[45] Date of Patent: Sep. 29, 1998

[54] CONVEYING DEVICE FOR A RECORDING PAPER

[75] Inventor: Naoki Takatori, Saitama, Japan

[73] Assignee: Fuji Photo Film Co., Ltd., Kanagawa, Japan

[21] Appl. No.: 881,351

[22] Filed: Jun. 24, 1997

[30] Foreign Application Priority Data

Jun. 24, 1996 [JP] Japan ..... 8-163319
Jun. 24, 1996 [JP] Japan ..... 8-163320

[51] Int. Cl.[6] ..... B41J 13/03

[52] U.S. Cl. ..... 400/636.2; 347/218; 400/636

[58] Field of Search ..... 101/288; 400/636, 400/636.2, 636.3, 637, 637.2, 638, 639; 347/104, 105, 218

[56] References Cited

U.S. PATENT DOCUMENTS 4,999,649 3/1991 Saji et al. ..... 347/218
5,218,380 6/1993 Fiscella ..... 400/636
5,221,149 6/1993 Takekoshi et al. ..... 400/145.2

FOREIGN PATENT DOCUMENTS 2 207 886 2/1989 United Kingdom ..... 400/636

*Primary Examiner*—Christopher A. Bennett
*Attorney, Agent, or Firm*—Sughrue, Mion, Zinn, Macpeak & Seas, PLLC

[57] ABSTRACT

Two intermediate gears are respectively disposed between a driving gear and a driven gear so as to mesh with both thereof. The driving gear is driven by a pulse motor. The driven gear is integrally rotated with a capstan roller. Rotational velocities of the intermediate gears are different each other due to eccentricity of the driving gear. The driven gear is always rotated by the faster one of the intermediate gears so that influence by unevenness of rotational velocity of the driving gear is reduced. Accordingly, unevenness of conveying velocity for a recording paper may be reduced. Instead of disposing of the intermediate gears, two drive transmission systems may be arranged. One of the systems comprises a first driving gear and a first driven gear. Other of the systems comprises a second driving gear, a second driven gear and two intermediate gears. The capstan roller is always rotated by the faster one of the systems.

16 Claims, 11 Drawing Sheets

CONVEYING DEVICE FOR A RECORDING PAPER

BACKGROUND OF THE INVENTION

1. Field of the Invention

The present invention relates to a conveying device for a recording paper such as a heat sensitive recording paper.

2. Description of the Related Art

Recording paper conveying devices are used in various printers and copying machines. One type of conveying device has a capstan roller and a pinch roller. In this type, a recording paper is nipped by the capstan roller and the pinch roller to be conveyed. Another type of conveying device has a platen drum driven by a motor. In this type, a recording paper is wound on an outer periphery of the platen drum and conveyed.

FIG. 15 is a schematic view of a color thermal printer having the recording paper conveying device in which the capstan roller and the pinch roller are used. The color thermal printer prints a full color image, using a color heat sensitive recording paper 2 in which at least three kinds of heat sensitive color layers, for example, cyan heat sensitive color layer, magenta heat sensitive color layer and yellow heat sensitive color layer, are overlapped on a support member in that order.

The conveying device 3 comprises a driving gear 5, a driven gear 6, a capstan roller 7 and a pinch roller 8. The driving gear 5 has smaller diameter and is rotated by a motor 4. The driven gear 6 has greater diameter and meshes with the driving gear 5. The capstan roller 7 is coaxially provided with the driven gear 6 and integrally rotated therewith. The pinch roller 8 is free to rotate. The color heat sensitive recording paper 2 fed from paper feed side is nipped by the capstan roller 7 and the pinch roller 8. The recording paper 2 is conveyed in an order direction and in a reverse direction one after the other. The order direction is a direction from the paper feed side to the paper discharge side. The reverse direction is a direction from the paper discharge side to the paper feed side.

While the recording paper 2 is conveyed by the conveying device 3 in an order direction, a thermal head 9 nips the recording paper 2 with a platen roller 10 and thermal recording of three colors, namely, cyan, magenta and yellow are performed in order by heat. An optical fixing unit 11 fixes the recorded heat sensitive color layer optically before the next thermal recording is performed for the next color layer.

By the way, the driving gear 5 and the driven gear 6 are manufactured in dimensional accuracy of a permissible range. However, the center of each gear is biased by about 20 $\mu$m. Due to eccentricity thereof, a diameter of the pitch circle relative to meshing point of the driving gear 5 and the driven gear 6 changes by a trigonometric function. By the change of the pitch circle diameter, as shown by a solid line in FIG. 16, unevenness of the rotational velocity of the driving gear 5 is caused during a rotation thereof, namely during T1, although the motor 4 rotates at constant velocity. The unevenness of rotational velocity has width W1 and occurs for a prescribed rotational velocity, which is shown by a broken line in FIG. 16, relative to the meshing point of the driving gear 5 and a virtual gear.

As shown in FIG. 17, when the driven gear 6 is rotated, unevenness of the rotational velocity shown by dashed line 12 occurs during T2 in which the driven gear 6 makes a rotation with a virtual gear rotating at uniform velocity. The unevenness of rotational velocity has width W2 and occurs for a prescribed rotational velocity, which is shown by a broken line in FIG. 17, relative to the meshing point of the driven gear 6 and the virtual gear. The unevenness of the rotational velocity of the driven gear 6 has a longer cycle in comparison with that of the driving gear 5 because the diameter of the driven gear 6 is greater than that of the driving gear 5. The driven gear 6 is affected by the unevenness of the rotational velocity of the driving gear 5 so that, in practice, a smaller unevenness of rotational velocity occurs along a gentle unevenness of rotational velocity as shown by a solid line in FIG. 17. Similarly, as to the capstan roller 7 coaxially arranged with the driven gear 6, unevenness of rotational velocity occurs so that unevenness of conveyance velocity for the recording paper 2 occurs. As shown in FIG. 18, the unevenness of rotational velocity of the capstan roller 7 has width W5 and occurs for a prescribed rotational velocity, shown by a broken line.

The width of one line recorded by the thermal head 9 is about 150 $\mu$m. If an unevenness of conveyance velocity for the recording paper 2 occurs, contact time of the recording paper 2 with the thermal head 9 changes so that an unevenness of density occurs on the recording paper 2. As to the driven gear 6, the unevenness of rotational velocity thereof has a longer cycle so that if an unevenness of density occurs, it is not remarkable. Accordingly, the quality of print is not affected that much. However, as to the driving gear 5, the unevenness of rotational velocity thereof has a shorter cycle so that a stripe-like unevenness of density successively occurs at a short pitch. Therefore, there arises a problem where the quality of print deteriorates.

In order to improve an unevenness in conveying the paper, it is well known that a conveyor belt utilizing elasticity thereof is employed. However, in this case, the conveyor belt expands and contracts because the conveyance load of the recording unit changes due to a difference in print rate and so forth. Therefore, if the conveyor belt is employed, unevenness of the conveying the paper occurs.

In the case of transmitting a drive force by a gear, the gear does not expand and contract. Accordingly, the unevenness of conveyance due to a change of conveyance load does not occur. However, in this case, as the gear has hardness, there arises a problem in that cyclic unevenness of conveyance occurs. The unevenness of conveyance is caused by eccentricity of the gear.

SUMMARY OF THE INVENTION

In view of the foregoing, it is a primary object of the present invention to provide a conveying device for a recording paper in which unevenness of conveyance of the recording paper is prevented.

It is a second object of the present invention to provide a conveying device for a recording paper in which cyclic unevenness of conveyance and unevenness of conveyance due to change of conveyance load are solved in using a simple structure.

It is a third object of the present invention to provide a conveying device for a recording paper in which good quality of print is maintained.

In order to achieve the above and other objects, the conveying device for the recording paper comprises a plurality of intermediate gears, each of which meshes with both a driving gear and a driven gear. The driving gear is rotated by a pulse motor. The driven gear is coaxially provided with a capstan roller and is integrally rotated therewith. The capstan roller nips the recording paper with a pinch roller and conveys the recording paper to print an image on it.

Instead of the capstan roller, a platen drum to which a driven gear is coaxially attached may be used. The recording paper is wound on an outer periphery of the platen drum.

In a preferred embodiment, two intermediate gears are disposed between the driving gear and the driven gear. Due to eccentricity of the driving gear, the intermediate gears rotated by the driving gear have a different rotational velocity from each other. The driven gear meshing with the intermediate gears is rotated by one of the intermediate gears, which has a faster rotational velocity. As a result, any influence by an unevenness of rotational velocity of the driving gear is reduced so that the unevenness of rotational velocity of the driven gear is reduced. As the capstan roller is integrally rotated with the driven gear, unevenness of conveying velocity for a recording paper may be reduced.

In an another embodiment, a plurality of drive transmission systems are arranged between a pulse motor and a capstan roller. Similarly to the foregoing, the capstan roller conveys the recording paper with a pinch roller. The drive transmission systems have the same reduction ratio.

One of the drive transmission systems comprises a first driving gear and a first driven gear which is coaxially provided with the capstan roller. The first driving gear is rotated by the pulse motor. The first driven gear meshes with the first driving gear directly. Another of the drive transmission systems comprises a second driving gear, a second driven gear and two intermediate gears. The second driving gear is coaxially provided with the first driving gear. The second driven gear is coaxially provided with the first driven gear. The second driven gear is rotated in accordance with the rotation of the second driving gear via the two intermediate gears. The capstan roller is always rotated by the fastest one of the drive transmission systems. Accordingly, unevenness of rotational velocity of the capstan roller is reduced so that unevenness of conveying velocity for a recording paper may be reduced.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT(S)

Figure 1:
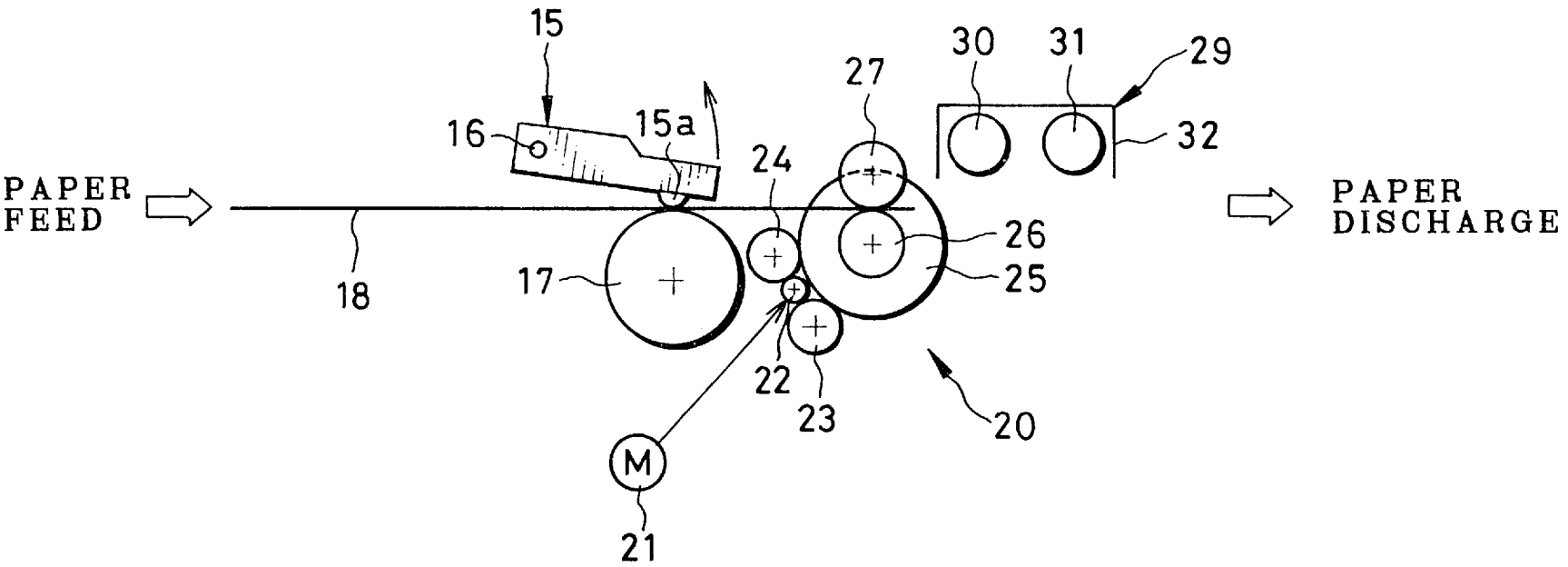
FIG. 1 is a schematic illustration of a color thermal printer employing a conveying device for a recording paper according to the present invention.

FIG. 1 shows a thermal printer in which a conveying device for a recording paper according to the present invention is employed, a thermal head 15 is provided with a heating element array 15*a*. The array 15*a* includes a plurality of heating elements arranged in line. The thermal head 15 is swingable around a support shaft 16 and swings between a print position and a separate position. In the print position, the thermal head 15 presses a color heat sensitive recording paper 18 located on a platen roller 17. In the separate position, the thermal head 15 is separated from the platen roller 17.

The color heat sensitive recording paper 18 comprises a cyan heat sensitive color layer, a magenta heat sensitive color layer and a yellow heat sensitive color layer, which are overlapped on a support member in that order. The yellow heat sensitive color layer, which is the top layer, has the highest heat sensitivity and is colored in yellow by a smaller heat energy. The cyan heat sensitive color layer, which is the bottom layer, has the lowest heat sensitivity and is colored in cyan by a larger heat energy. The yellow heat sensitive color layer loses color ability when an ultraviolet ray of 420 nm is radiated. The magenta heat sensitive color layer is colored in magenta by a middle heat energy between the yellow and the cyan heat sensitive color layers and loses color ability when an ultraviolet ray of 365 nm is radiated. The recording paper 18 may be further provided with a black heat sensitive color layer and constituted of four layers.

At the downstream side of the thermal head 15, a recording paper conveying device 20 is disposed. The conveying device 20 is constituted of a driving gear 22, two intermediate gears 23 and 24, a driven gear 25, a capstan roller 26, and a pinch roller 27. The driving gear 22 has a smaller diameter and is rotated by a pulse motor 21. The intermediate gears 23 and 24 mesh with the driving gear 22. The driven gear 25 has a greater diameter and meshes with the intermediate gears 23 and 24. The capstan roller 26 is coaxially arranged with the driven gear 25 and integrally rotated therewith. The pinch roller 27 is disposed above the capstan roller 26 and free to rotate. The pinch roller 27 is moved between a nip position and a separate position. In the nip position, the pinch roller 27 presses the capstan roller 26 and nips the recording paper 18 therewith. In the separate position, the pinch roller 27 is separated from the capstan roller 26.

Figure 2:
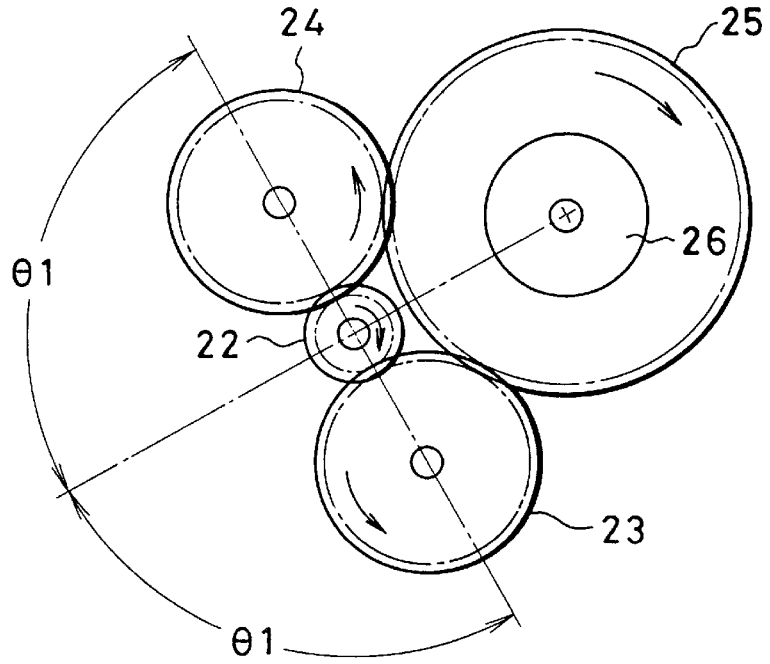
FIG. 2 is an explanatory view showing positional relationship of elements constituting the conveying device.

The numbers of teeth of the driven gear 25, the intermediate gears 23 and 24, and the driving gear 22 are respectively, for example, 128, 32, and 16 so that the reduction ratio is 8:2:1. Accordingly, while the driving gear 22 makes eight rotations, the driven gear 25 makes a rotation. As shown in FIG. 2 illustrating an arrangement of the intermediate gears 23 and 24 for the driving gear 22 and the driven gear 25, as the numbers of teeth of the intermediate gears are same, angles formed by two straight lines are same θ1 (for example 90 degrees). One of the straight lines is a line passing through a center of the driving gear 22 and a center of the driven gear 25. The other of the straight lines is a line passing through the center of the driving gear 22 and each center of the intermediate gears 23 and 24. The intermediate gears 23 and 24 are arranged around the driving gear 22 at equal intervals so that rotational velocities of the intermediate gears 23 and 24 are different due to the eccentricity of the driving gear 22. The driven gear 25 meshes with one of the intermediate gears which has a faster rotational velocity. In other words, the driven gear 25 is rotated by the faster one of intermediate gears 23 and 24 at each time.

When the driven gear 25 is rotated by one of the intermediate gears, the driven gear 25 rotates faster than the other of the intermediate gears, namely, the lower one of the intermediate gears 23 and 24. At this time, the driven gear 25 causes this intermediate gear to rotate. However, the rotation of the driven gear 25 is absorbed due to backlash between the driven gear 25 and the intermediate gear so that break of a tooth or the like does not occur.

Figure 3:
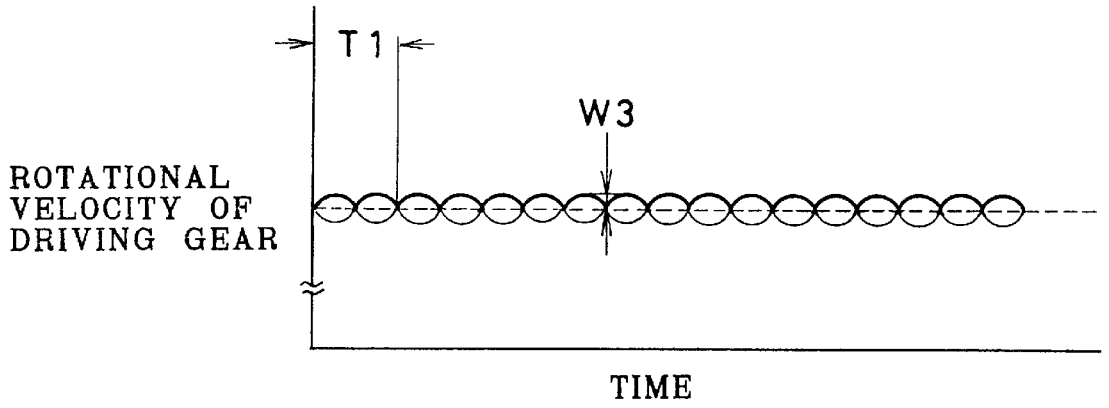
FIG. 3 is a graph showing rotational velocity of a driving gear.

In such a manner, the driven gear 25 is rotated by the faster one of the two intermediate gears 23 and 24. On the supposition that the intermediate gears are not existent, the rotational velocity of the driving gear 22 at a virtual meshing point is shown in FIG. 3. A chance of the rotational velocity, a width of which is W3, is reduced.

In the conveying device 20, the recording paper 18 is fed from the paper feed side. When a leading edge of the recording paper 18 enters a space between the capstan roller 26 and the pinch roller 27, the pinch roller 27 is moved to the nip position to nip the paper 18 with the capstan roller 26. By rotating the pulse motor 21 in the order direction or in the reverse direction, the capstan roller 26 is rotated in the order direction or in the reverse direction via the driving gear 22, the intermediate gears 23 and 24 and driven gear 25. Accordingly, the recording paper 18 is conveyed in the order direction from the paper feed side to the paper discharge side or in the reverse direction from the paper discharge side to the paper feed side. The recording paper 18 is conveyed in two directions one after the other.

At the downstream side of the conveying device 20, an optical fixing unit 29 is disposed. The optical fixing unit 29 is constituted of a first ultra violet lamp 30 used for yellow, a second ultra violet lamp 31 used for magenta, and a reflector 32. The first ultra violet lamp 30 generates an ultraviolet ray of which a luminescence peak is 420 nm. The second ultra violet lamp 31 generates ultraviolet ray of which a luminescence peak is 365 nm. The reflector 32 covers the back of the ultra violet lamps 30 and 31.

Next, operation of the above embodiment is described. Upon working a print key (not shown), a paper feed process is started. The recording paper 18 is fed from a paper feed cassette (not shown) and conveyed toward the thermal head 15. During the paper feed process, the thermal head 15 is kept in the separate position, in other words, the thermal head 15 is separated from the platen roller 17. Similarly, the pinch roller 27 is kept in the separate position, in other words, the pinch roller 27 is separated from the capstan roller 26. The fed recording paper 18 passes through a space between the thermal head 15 and the platen roller 17. Further, the recording paper 18 passes through a space between the pinch roller 27 and the capstan roller 26. When the leading edge of the recording paper 18 is detected by a position sensor (not shown), the paper feed process is over.

After the thermal head 15 is moved to the print position, the pulse motor 21 rotates the driving gear 22 in the clockwise direction in FIG. 1. The driving gear 22 rotates each of the intermediate gears 23 and 24 in counterclockwise direction so that the driven gear 25 is rotated in a clockwise direction. By the rotation of the driven gear 25, the capstan roller 26 is also rotated in the same direction. The recording paper 18 is nipped by the capstan roller 26 and the pinch roller 27, and conveyed in the order direction, namely, toward the paper discharge side.

During the conveyance, each heating element of the thermal head 15 generates heat energy in accordance with yellow image data to perform thermal recording of an yellow image. The yellow image is recorded one line by one line in a record area on the recording paper 18. During the thermal recording, the ultra violet lamp 30 is turned on so that the yellow heat sensitive color layer thermally recorded is fixed optically.

Figure 4:
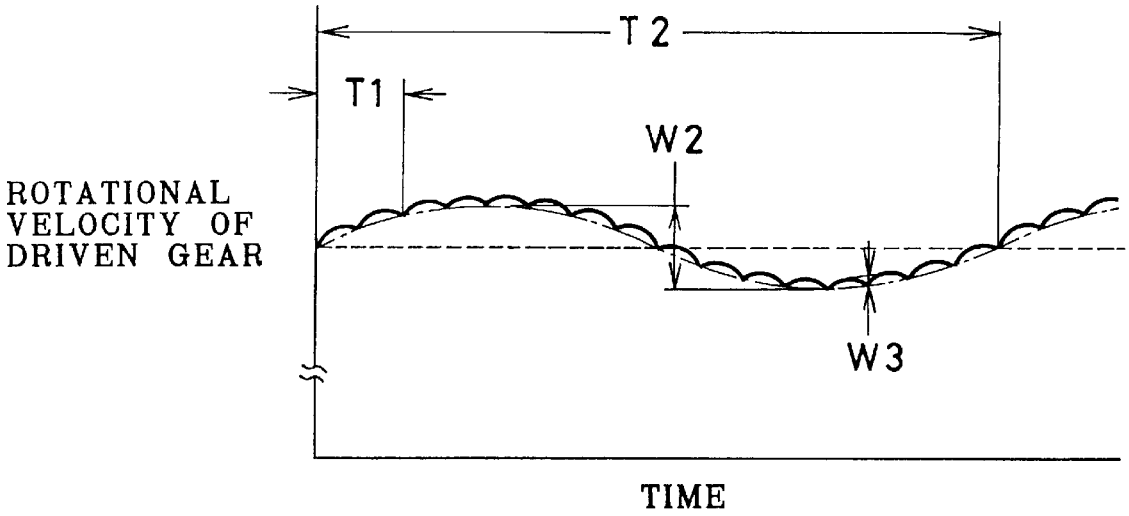
FIG. 4 is a graph showing rotational velocity of a driven gear.

The driven gear 25 is always rotated by the faster one of the intermediate gears 23 and 24. On the supposition that the intermediate gears 23 and 24 are not existent, the rotational velocity of the driving gear 22 at virtual meshing point is shown in FIG. 3. With respect to the rotational velocity of the driven gear 25, as shown in FIG. 4, a smaller unevenness of rotational velocity due to eccentricity of the driving gear 22 occurs along a gentle unevenness of rotational velocity due to eccentricity of the driven gear 25. The unevenness of rotational velocity of the driving gear 22 has width W3, however, the width is about half of the conventional unevenness of rotational velocity. Accordingly, short-pitch unevenness of density due to the unevenness of the conveyance velocity for the recording paper 18 may be reduced.

After thermal recording of the yellow image is over for the record area of the recording paper 18, the thermal head 15 is moved to the separate position. Moreover, the pulse motor 21 is stopped once and rotated in reverse direction. Thus, the capstan roller 26 is rotated in counterclockwise direction to convey the recording paper 18 in a reverse direction.

When a leading edge of the record area reaches a position of the thermal head 15, the pulse motor 21 is stopped. After that, the thermal head 15 is moved to the print position and the pulse motor 21 is rotated in an order direction. Thus, the paper 18 is conveyed in an order direction again. During this conveyance, thermal recording of a magenta image is performed by the thermal head 15. Further, optical fixing for the magenta heat sensitive color layer is also performed by the ultra violet lamp 31. While the thermal recording of the magenta image is performed, similarly, unevenness of rotational velocity of the capstan roller 26 is reduced. Therefore, occurrence of stripe-like unevenness of density is reduced for the magenta image.

After thermal recording of the magenta image is over for the record area of the recording paper 18, the thermal head 15 is moved to the separate position. Moreover, the pulse motor 21 is stopped once and rotated in a reverse direction. Thus, the capstan roller 26 is rotated in a counterclockwise direction to convey the recording paper 18 in a reverse direction.

When a leading edge of the record area reaches a position of the thermal head 15, the pulse motor 21 is stopped. After that, the thermal head 15 is moved to the print position and the pulse motor 21 is rotated in an order direction. Thus, the paper 18 is conveyed in an order direction again. During this conveyance, thermal recording of a cyan image is performed by the thermal head 15. While the thermal recording of the cyan image is performed, similarly, an unevenness of rotational velocity of the capstan roller 26 is reduced. Therefore, occurrence of a stripe-like unevenness of density is reduced for the cyan image. By the way, the cyan heat sensitive color layer has heat sensitivity such as not to color in an ordinary storage state, so that optical fixing is not performed for it.

Upon finishing the thermal recording of the cyan image for the record area of the recording paper 18, an end side of the paper 18 is bleached by the ultra violet lamp 31 and the recording paper 18 is discharged to a paper discharge tray (not shown). After the recording paper 18 is discharged, the pulse motor 21 is stopped and the ultra violet lamp 31 is turned off. Further, the pinch roller 27 is moved to the separate position.

Figure 5:
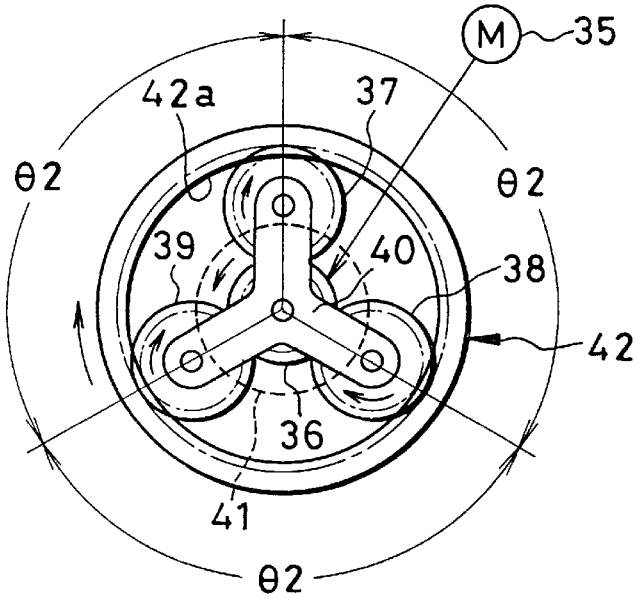
FIG. 5 is a schematic illustration showing construction of conveying device for the recording paper according to a second embodiment.

FIG. 5 shows a second embodiment of the conveying device according to the present invention. In this embodiment, three intermediate gears 37, 38 and 39 meshing with a driving gear 36 are disposed around the driving gear 36 at equal intervals. Angle of the interval is θ2, namely, 120 degrees. The driving gear 36 has a smaller diameter and is driven by a pulse motor 35. The driving gear 36 and the intermediate gears 37, 38 and 39 are rotatably attached to a support arm 40 having a trifurcate shape. The support arm 40 is fixedly secured to a frame of the conveying device 20. A driven gear 42 coaxially provided with a capstan roller 41 is an internal gear having teeth 42*a*. The teeth 42*a* are formed on a circular inner wall of the driven gear 42 and mesh with the three intermediate gears 37, 38 and 39.

Figure 6:
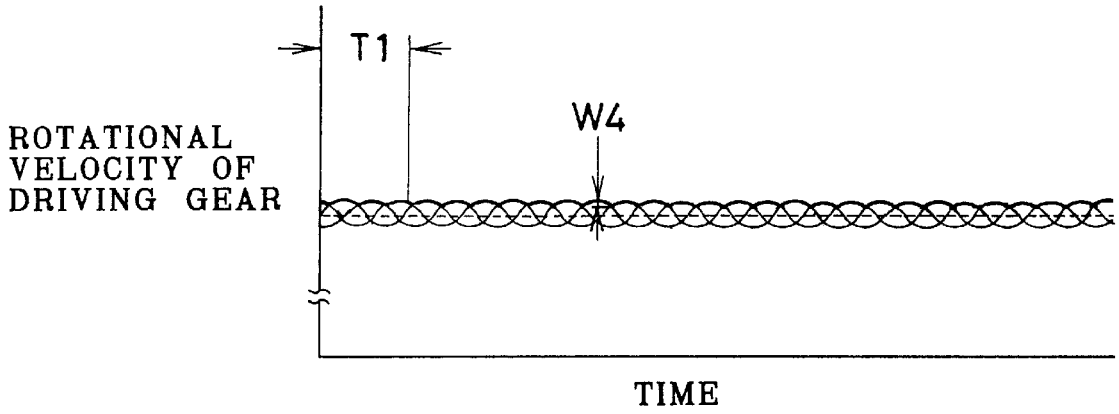
FIG. 6 is a graph showing rotational velocity of a driving gear in the second embodiment.
Figure 7:
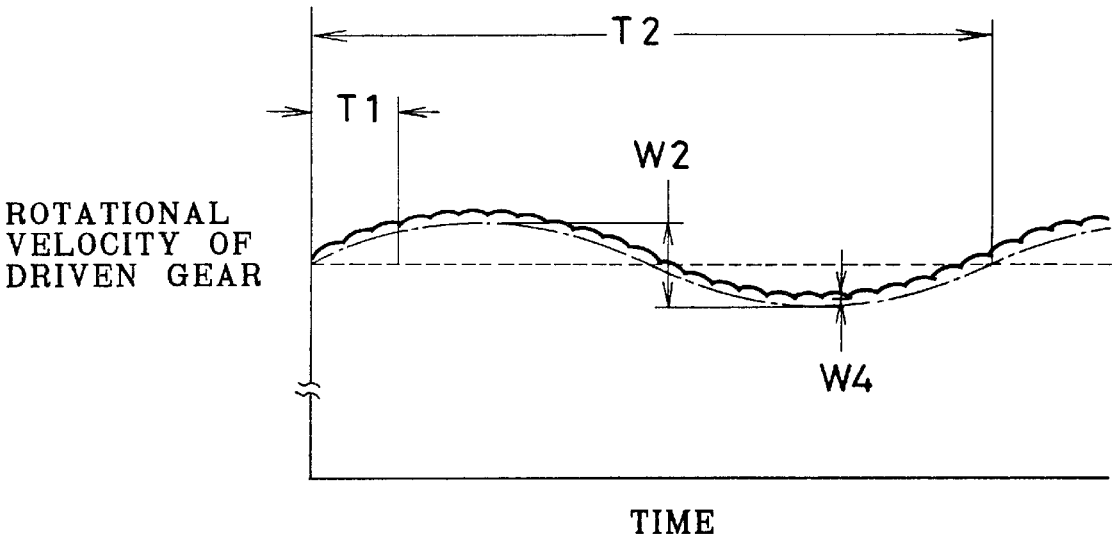
FIG. 7 is a graph showing rotational velocity of a driven gear in the second embodiment.

When the driving gear 36 is rotated by the pulse motor 35 in a counterclockwise direction in FIG. 5, each of the intermediate gears 37, 38 and 39 is rotated in a clockwise direction. Accordingly, the driven gear 42 is rotated in a clockwise direction as well. Due to eccentricity of the driving gear 36, rotational velocities of the intermediate gears 37, 38 and 39 are different each other. The driven gear 42 is always rotated by the intermediate gear having the fastest rotational velocity. Thus, on the supposition that the intermediate gears 37, 38 and 39 are not existent, a rotational velocity of the driving gear 36 at virtual meshing point is shown in FIG. 6. As to a small unevenness of rotational velocity of the driven gear 42, the width thereof is reduced to W4 as shown in FIG. 7. Accordingly, an unevenness of density due to the thermal head is also reduced.

Figure 8:
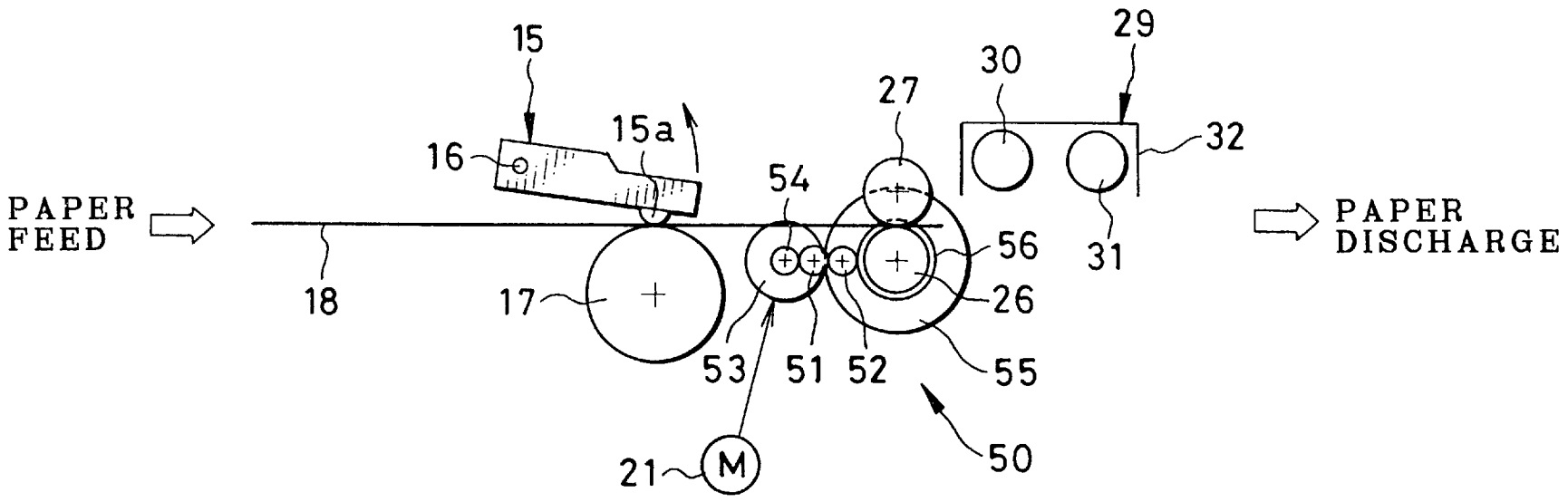
FIG. 8 is a schematic illustration of a color thermal printer employing a conveying device for the recording paper according to a third embodiment.

FIG. 8 shows a third embodiment of the conveying device according to the present invention. In this embodiment, the same reference numerals used in FIG. 1 denote similar parts. In FIG. 8, the conveying device 50 is disposed at downstream side of a thermal head 15.

Figure 9:
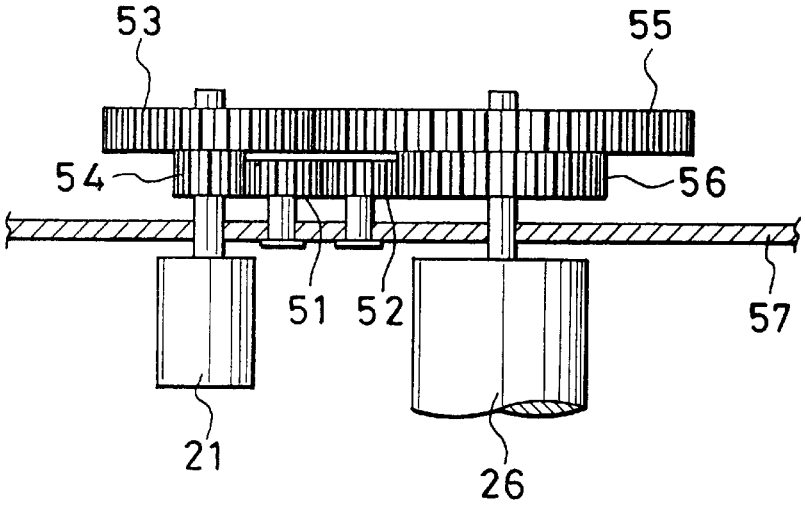
FIG. 9 is a plane view showing a construction of the conveying device for the recording paper according to the third embodiment.

Two drive transmission systems are provided between the pulse motor 21 and the capstan roller 26. As shown in FIG. 9, the first drive transmission system comprises a first driving gear 53 rotated by the pulse motor 21 and a first driven gear 55 meshing with the first driving gear 53. The first driven gear 55 is coaxially provided with the capstan roller 26 and integrally rotated therewith. Numbers of teeth of the first driving gear 53 and the first driven gear 55 are respectively, for example, 20 and 40 so that a reduction ratio thereof is 1:2. Accordingly, while the driving gear 53 makes two rotations, the driven gear 55 makes a rotation.

The second drive transmission system comprises a second driving gear 54, a second driven gear 56, a first intermediate gear 51 and a second intermediate gear 52. The second driving gear 54 is coaxially provided with the first driving gear 53 and is integrally rotated therewith. The second driven gear 56 is coaxially provided with the capstan roller 26 and the first driven gear 55, and is integrally rotated therewith. The intermediate gears 51 and 52 have a similar shape and are disposed between the second driving gear 54 and the second driven gear 56. The numbers of teeth of the second driving gear 54, the intermediate gears 51 and 52, and the second driven gear 56 are respectively, for example, 10, 15, 15 and 20 so that a reduction ratio of the second driving gear 54 and the second driven gear 56 is 1:2. Thus, the reduction ratio of the second drive transmission system is similar to that of the first drive transmission system. The capstan roller 26, the pulse motor 21, the first drive transmission system and the second drive transmission system are attached to a frame 57.

In such a manner, when a plurality of drive transmission systems are provided, a pitch circle diameter with regard to each gear of each drive transmission system changes in a different state from each other. Accordingly, the capstan roller 26 is always rotated by one of the drive transmission systems which has a faster rotational velocity so that an unevenness of rotational velocity is reduced.

As to the conveying device 50, the recording paper 18 is fed from the paper feed side. When a leading edge of the recording paper 18 enters a space between the capstan roller 26 and the pinch roller 27, the pinch roller 27 is moved to the nip position to nip the recording paper 18 with the capstan roller 26. In accordance with rotation of the pulse motor 21 in an order direction or in a reverse direction, the first drive transmission system and the second drive transmission system rotate the capstan roller 26 in an order direction or in a reverse direction. Accordingly, the recording paper 18 is conveyed in an order direction from a paper feed side to a paper discharge side or in a reverse direction from a paper discharge side to a paper feed side.

Next, operation of the third embodiment is described. Upon working a print key (not shown), paper feed process is started. The recording paper 18 is fed from a paper feed cassette (not shown) and conveyed toward the thermal head 15. During the paper feed process, the thermal head 15 is kept in the separate position, in other words, the thermal head 15 is separated from the platen roller 17. Similarly, the pinch roller 27 is kept in the separate position, in other words, the pinch roller 27 is separated from the capstan roller 26. The fed recording paper 18 passes through a space between the thermal head 15 and the platen roller 17. Further, the recording paper 18 passes through a space between the pinch roller 27 and the capstan roller 26. When the leading edge of the recording paper 18 is detected by a position sensor (not shown), the paper feed process is over.

After the thermal head 15 is moved to the print position, the pulse motor 21 rotates the first driving gear 53 and the second driving gear 54 in a counterclockwise direction in FIG. 8. The first driving gear 53 rotates the first driven gear 55 meshing therewith in a clockwise direction. The second driving gear 54 rotates the second driven gear 56 in a clockwise direction via the intermediate gears 51 and 52. Thus, the capstan roller 26 is also rotated in a clockwise direction. The recording paper 18 is nipped by the capstan roller 26 and the pinch roller 27, and conveyed in a order direction, namely, toward the paper discharge side.

Figure 10:
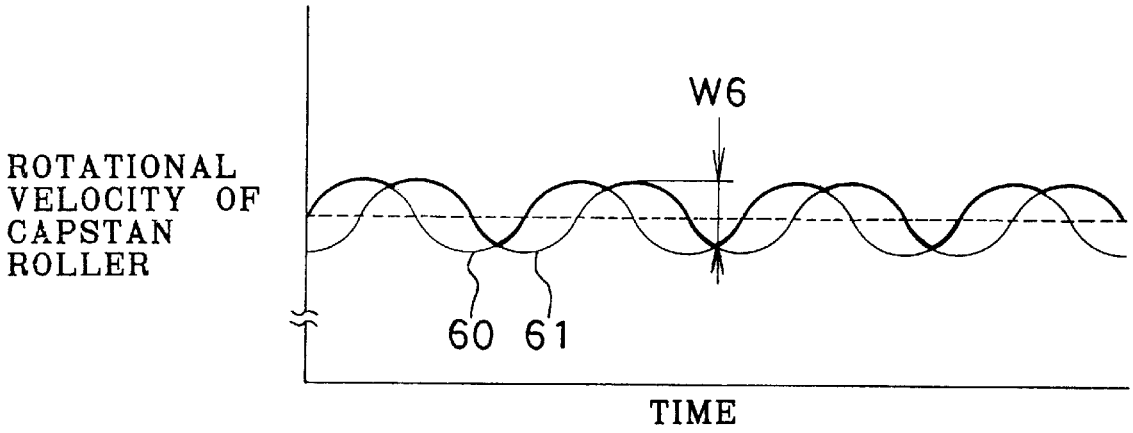
FIG. 10 is a graph showing rotational velocity of a capstan roller in the third embodiment.

Reference numerals 60 and 61 shown in FIG. 10 represent rotational states of the first driven gear 55 and the second driven gear 56 respectively. As to the first driven gear 55 and the second driven gear 56, an unevenness of rotational velocity occurs due to eccentricity and deflection of each gear. However, there is a high probability that the unevenness of rotational velocity with regard to each of the first driven gear 55 and the second driven gear 56 occurs in a different state from each other. Accordingly, the capstan roller 26 is always rotated in accordance with the driven gear having faster rotational velocity, as shown by a bold line in FIG. 10. Thus, the width W6 of the unevenness of rotational velocity with regard to the capstan roller 26 is reduced rather than the width of conventional unevenness of rotational velocity, so that an unevenness of density is reduced. Moreover, when phases of the unevenness of rotational velocity with regard to the first and the second drive transmission systems are inversely related, the width of the unevenness of rotational velocity is further reduced. Therefore, the unevenness of density is reduced still more.

After the thermal recording of the yellow image was over, operations similar to that of the above-described embodiment are carried out.

Figure 11:
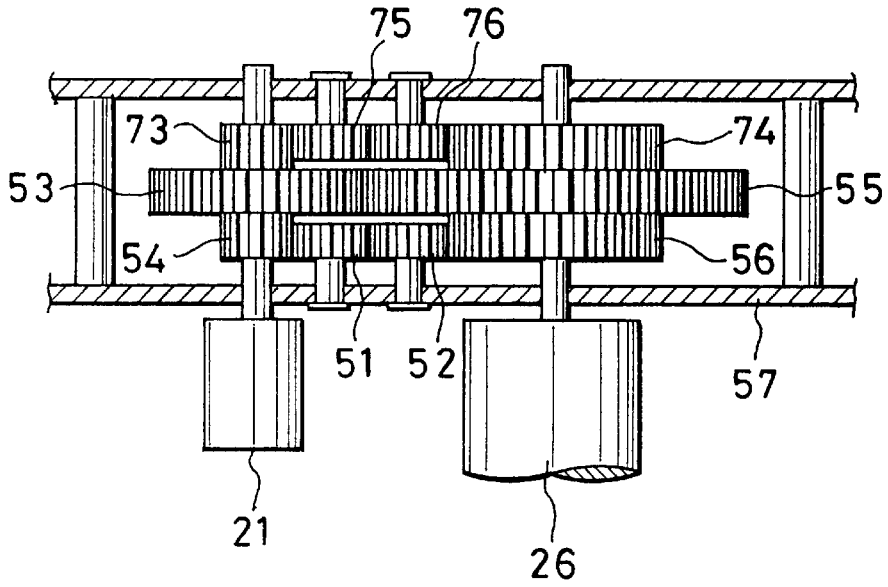
FIG. 11 is a plane view showing a construction of a conveying device for the recording paper according to a fourth embodiment.
Figure 12:
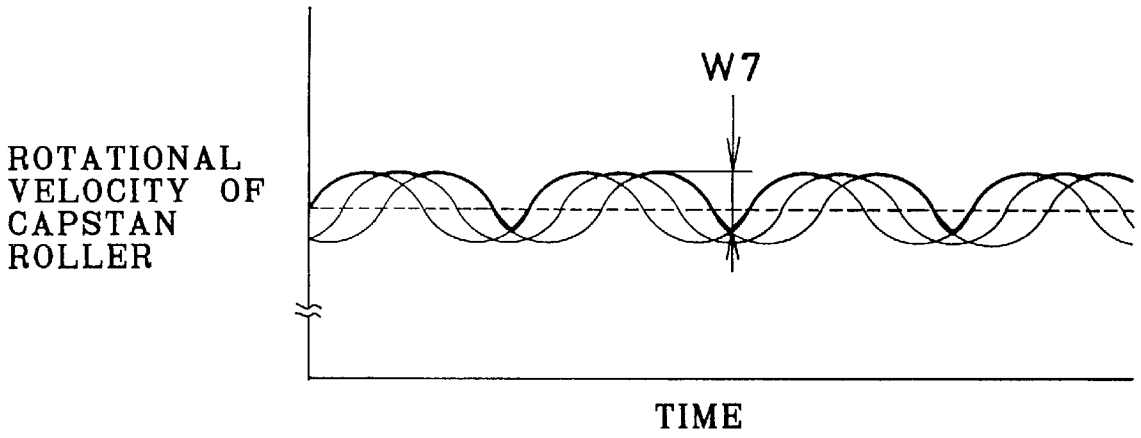
FIG. 12 is a graph showing rotational velocity of a capstan roller in the fourth embodiment.

FIG. 11 shows a fourth embodiment of the conveying device according to the present invention. In this embodiment, a third drive transmission system is added to the third embodiment described above. The third drive transmission system is similarly constituted to the second drive transmission system of the third embodiment. The third drive transmission system comprises a third driving gear 73, a third driven gear 74 and intermediate gears 75 and 76. According to this embodiment, a probability that an unevenness of rotational velocity with regard to each of the driven gears 55, 56 and 74 occurs in a different state from the others becomes more higher. Accordingly, as shown in FIG. 12, the width W7 of unevenness of rotational velocity with regard to the capstan roller 26 may be reduced so that unevenness of density may be reduced still more.

Figure 13:
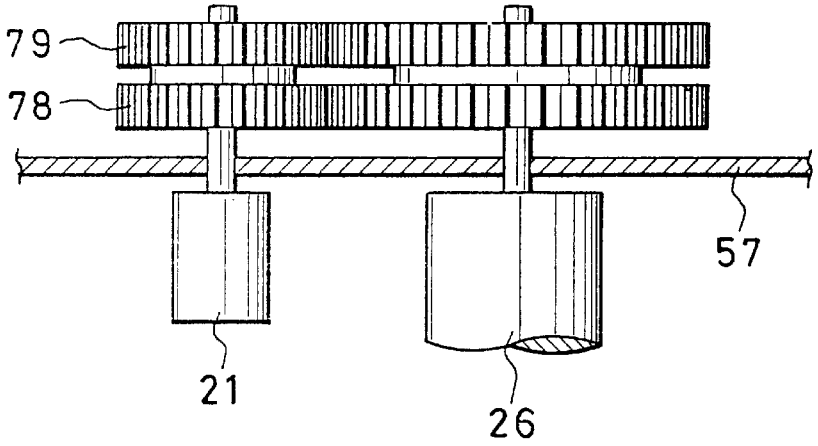
FIG. 13 is a plane view showing a construction of a conveying device for the recording paper according to a fifth embodiment.
Figure 18:
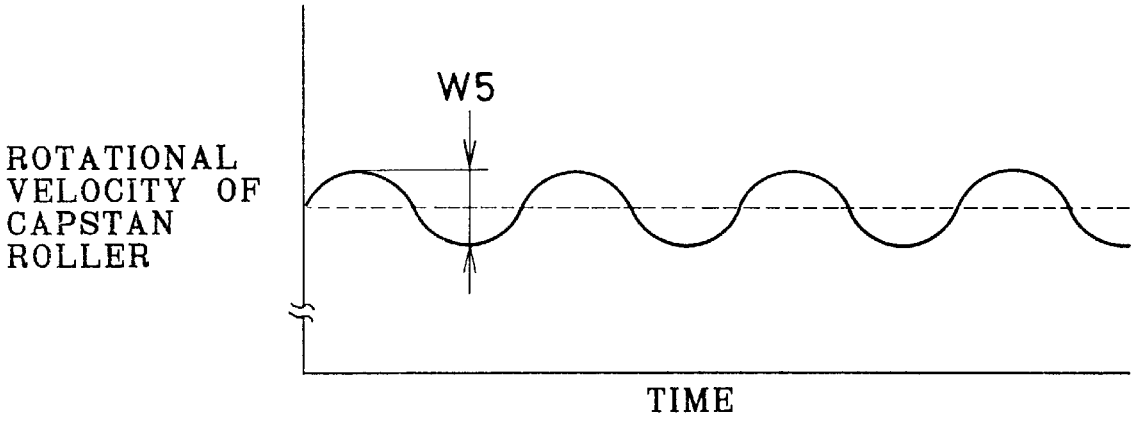
FIG. 18 (PRIOR ART)
FIG. 18 is a graph showing rotational velocity of a capstan roller in conventional device.

Moreover, as shown in FIG. 13, constitution of a first drive transmission system 78 may be similar to that of a second drive transmission system 79. At this time, an unevenness of density may be similarly reduced.

Figure 14:
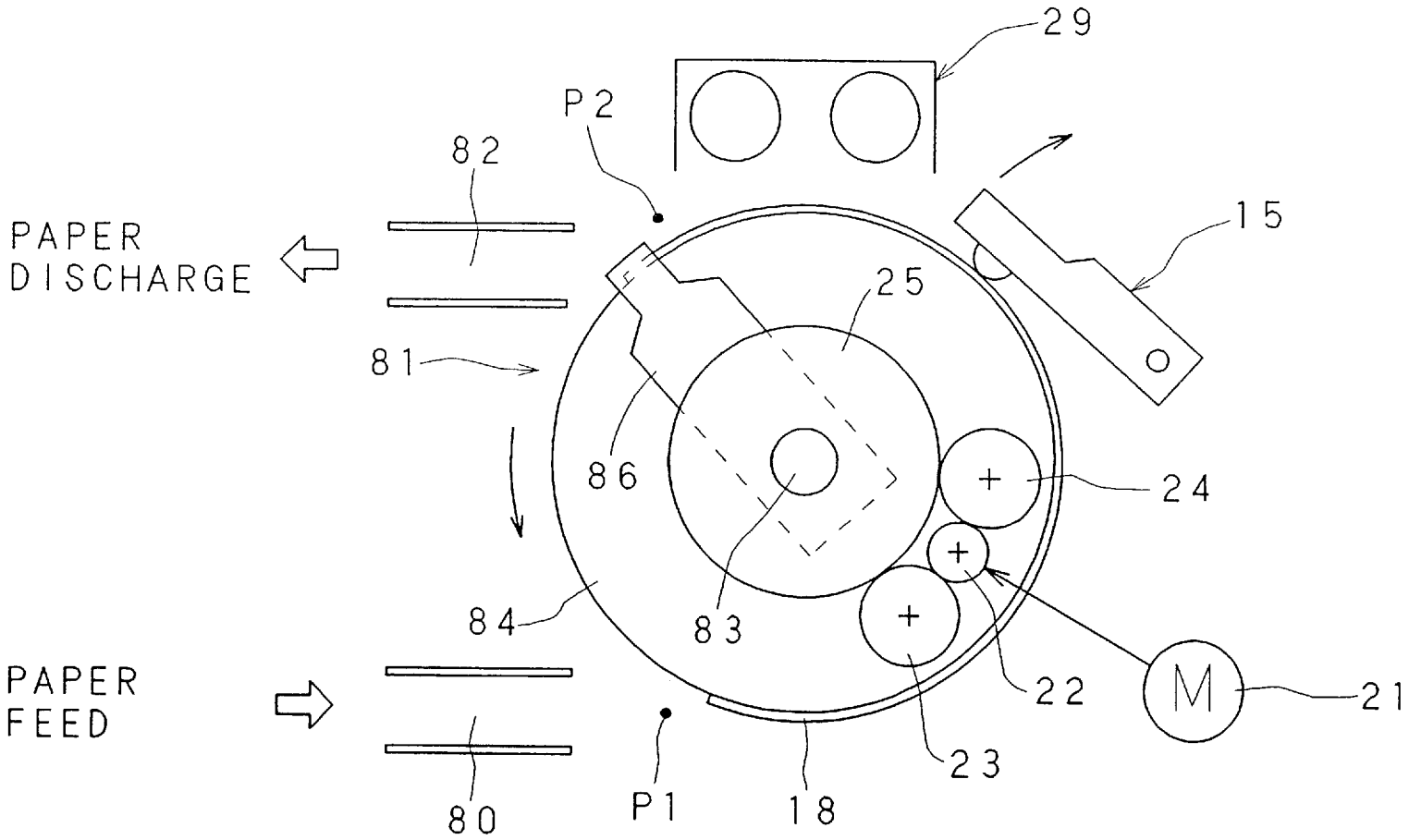
FIG. 14 is a schematic illustration of a color thermal printer employing a conveying device for the recording paper according to a sixth embodiment.
Figure 15:
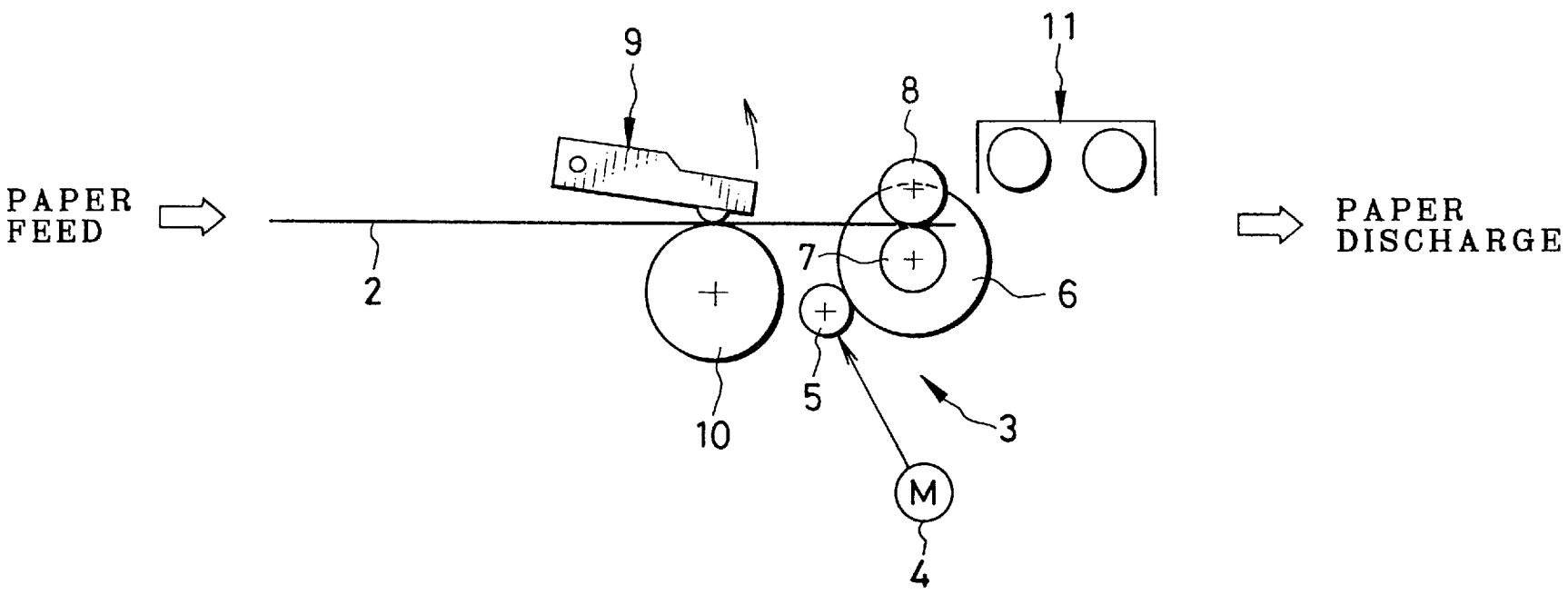
FIG. 15 (PRIOR ART)
FIG. 15 is a schematic illustration of a color thermal printer employing a conventional conveying device for the recording paper.
Figure 16:
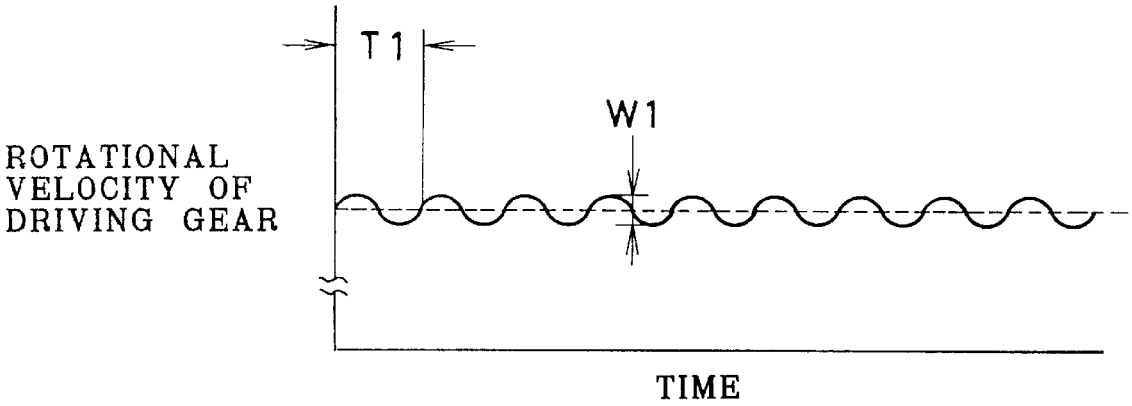
FIG. 16 (PRIOR ART)
FIG. 16 is a graph showing rotational velocity of a conventional driving gear.
Figure 17:
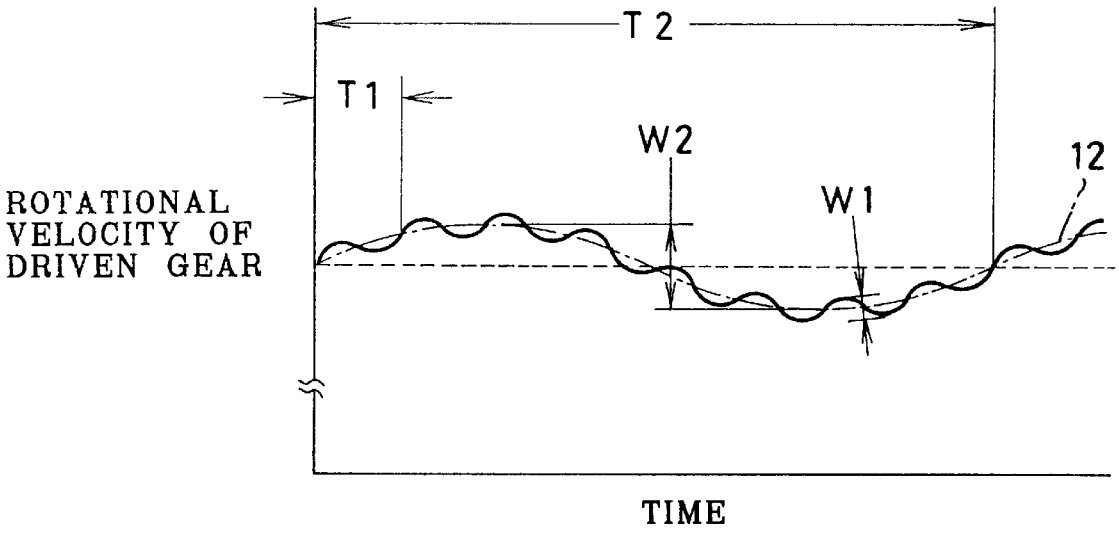
FIG. 17 (PRIOR ART)
FIG. 17 is a graph showing rotational velocity of a conventional driven gear.

In the above-described embodiment, the recording paper is nipped with the capstan roller and the pinch roller to be conveyed. However, some of the various printers and copying machines use a platen drum having a greater diameter. In this case, the recording paper is wound on an outer periphery of the platen drum and conveyed. FIG. 14 shows a color thermal printer in which the platen drum is attached. In this embodiment, the color thermal printer is well known so that a detailed description is omitted. Further, similar parts to that of the above-described embodiments are denoted by similar reference numerals.

The color thermal printer has a paper feed passage 80 provided at lower portion thereof. A recording paper 18 is fed from the paper feed passage 80 and supplied to a recording paper conveying device 81. The conveying device 81 keeps the recording paper 18 and makes three rotations. During each rotation, a thermal head 15 arranged at outside of the conveying device 81 presses the recording paper 18 and carries out thermal recording of yellow, magenta and cyan respectively. An optical fixing unit 29 fixes yellow heat sensitive color layer and a magenta heat sensitive color layer. When the thermal recording is over, the recording paper 18 is discharged from a paper discharge passage 82 provided at an upper portion of the thermal printer.

The conveying device 81 is provided with a platen drum 84, a driven gear 25, a driving gear 22, and intermediate gears 23 and 24. The platen drum 84 has a greater diameter and is rotatably supported by a platen shaft 83. The driven gear 25 is attached to the platen shaft 83. The driving gear 22 is rotated by a pulse motor 21. The intermediate gears 23 and 24 mesh with both of the driving gear 22 and the driven gear 25. Between the platen drum 84 and the driven gear 25, a clamp 86 is provided. The clamp 86 is movable between a press position in that the clamp 86 presses the peripheral surface of the platen drum 84 and a separate position in that the clamp 86 is separated from the platen drum 84. The clamp 86 nips a leading edge of the recording paper 18 fed from the paper feed passage 80 to keep the recording paper 18 on the outer periphery of the platen drum 84.

While the recording paper 18 is fed, the clamp 86 is stopped at a position P1 in FIG. 14 and moved to the separate position. When the leading edge of the recording paper 18 enters a gap between the platen drum 84 and the clamp 86, the clamp 86 presses the peripheral surface of the platen drum 84 to nip the leading edge of the recording paper 18. The recording paper 18 is wound on the outer periphery of the platen drum 84 by rotating the platen drum 84 in counterclockwise direction in FIG. 14.

While the recording paper 18 is discharged, the clamp 86 is stopped at a position P2 in FIG. 14 and separated from the peripheral surface of the platen drum 84. The platen drum 84 continues to rotate in a state that the thermal head 15 contacts the recording paper 18 so that the leading edge of the recording paper 18 is sent to the paper discharge passage 82 and discharged.

The driving gear 22 is rotated by the pulse motor 21 in a counterclockwise direction and the intermediate gears 23 and 24 are rotated in clockwise direction. Thus, the driven gear 25 is rotated in a counterclockwise direction. The platen drum 84 is integrally rotated with the driven gear 25 so that the platen drum 84 is rotated in a counterclockwise direction. The driven gear 25 is always rotated by the intermediate gear having a faster rotational velocity. Accordingly, a short-pitch unevenness of density due to an unevenness of conveyance velocity of the recording paper 18 may be reduced similar to the color thermal printers described in the above embodiments.

In the above-described embodiments, the present invention is applied for the thermal printer of heat sensitive type. However, the present invention may be applied for heat transfer type. Moreover, the present invention may be applied for a monochrome thermal printer in addition to the color thermal printer. Further, besides the thermal printer, the present invention may be applied for various devices in which recording is performed on a paper, conveying the paper at constant velocity. As such devices, there are, for example, a laser printer, an ink jet printer, a dot printer, a copying machine, and a facsimile. Furthermore, drive transmission systems of more than three rows may be provided.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A conveying device for a recording paper, comprising:

a motor;

a driven gear;

a driving gear for transmitting drive force of said motor to said driven gear;

a capstan roller coaxially provided with said driven gear and integrally rotated therewith;

a rotatable pinch roller pressing said capstan roller, said recording paper being nipped by said capstan roller and said pinch roller and conveyed in accordance with a rotation of said capstan roller; and a plurality of intermediate gears for meshing with both of said driving gear and said driven gear, said intermediate gears transmitting a same direction of rotation of said driving gear to said driven gear.

2. A conveying device for a recording paper according to claim 1, wherein each of said plurality of intermediate gears have a same number of teeth as each other and said intermediate gears are disposed at equal intervals around said driving gear.

3. A conveying device for a recording paper according to claim 2, wherein each of said driving gear, said intermediate gears and said driven gear have an outer periphery thereof, and teeth are formed on each said outer periphery.

4. A conveying device for a recording paper according to claim 2, wherein said driven gear is an internal gear including a center and an inner periphery thereof, said internal gear having teeth formed on said inner periphery thereof, said driving gear being positioned at said center of said internal gear and said intermediate gears being positioned around said driving gear.

5. A conveying device for a recording paper according to claim 4, further comprising:

a support arm for supporting said driving gear and said intermediate gears, said driving gear and said intermediate gears being rotatably attached to said support arm.

6. A conveying device for a recording paper, comprising:

a motor;

a driven gear;

a driving gear for transmitting drive force of said motor to said driven gear;

a platen drum having an outer periphery thereof and coaxially provided with said driven gear and integrally rotated therewith;

said platen drum having said recording paper being wound around said outer periphery thereof and conveyed in accordance with a rotation of said platen drum; and a plurality of intermediate gears for meshing with both of said driving gear and said driven gear, said intermediate gears transmitting a same direction of rotation of said driving gear to said driven gear.

7. A conveying device for a recording paper according to claim 6, wherein each of said plurality of intermediate gears have a same number of teeth as each other and said intermediate gears are disposed at equal intervals around said driving gear.

8. A conveying device for a recording paper, comprising:

a motor;

a driven gear;

a driving gear for transmitting drive force of said motor to said driven gear;

a capstan roller coaxially provided with said driven gear and integrally rotated therewith;

a rotatable pinch roller pressing said capstan roller, said recording paper being nipped by said capstan roller and said pinch roller and conveyed in accordance with a rotation of said capstan roller; and a plurality of intermediate gears for meshing with both of said driving gear and said driven gear, said intermediate gears transmitting a rotation of said driving gear to said driven gear; and wherein each of said plurality of intermediate gears have a same number of teeth as each other and said intermediate gears are disposed at equal intervals around said driving gear;

wherein each of said driving gear, said intermediate gears and said driven gear have an outer periphery thereof, and teeth are formed on each said outer periphery.

9. A conveying device for a recording paper, comprising:

a motor;

a driven gear;

a driving gear for transmitting drive force of said motor to said driven gear;

a capstan roller coaxially provided with said driven gear and integrally rotated therewith;

a rotatable pinch roller pressing said capstan roller, said recording paper being nipped by said capstan roller and said pinch roller and conveyed in accordance with a rotation of said capstan roller; and a plurality of intermediate gears for meshing with both of said driving gear and said driven gear, said intermediate gears transmitting a rotation of said driving gear to said driven gear; and wherein said driven gear is an internal gear including a center and an inner periphery thereof, said internal gear having teeth formed on said inner periphery thereof, said driving gear being positioned at said center of said internal gear and said intermediate gears being positioned around said driving gear.

10. A conveying device for a recording paper according to claim 9, wherein said plurality of intermediate gears comprises three intermediate gears.

11. A conveying device for a recording paper, comprising:

a motor;

a capstan roller rotated by said motor; and a rotatable pinch roller pressing said capstan roller, said capstan roller and said pinch roller nipping said recording paper and conveying said recording paper in accordance with a rotation of said capstan roller; and a plurality of drive transmission systems for transmitting a drive force of said motor to said capstan roller, each of said drive transmission systems having the same reduction ratio as each other; and wherein said drive transmission systems comprise:

a first drive transmission system; and a second drive transmission system;

said first drive transmission system comprising:

a first driving gear rotated by said motor; and a first driven gear meshing with said first driving gear and coaxially provided with said capstan roller;

said second drive transmission system comprising:

a second driving gear coaxially provided with said first driving gear;

a first intermediate gear meshing with said second driving gear;

a second intermediate gear meshing with said first intermediate gear; and a second driven gear meshing with said second intermediate gear and coaxially provided with said capstan roller.

12. A conveying device for a recording paper according to claim 11, wherein said drive transmission systems consist of a first drive transmission system and a second drive transmission system, said first drive transmission system being constituted of a first driving gear rotated by said motor and a first driven gear meshing with said first driving gear and coaxially provided with said capstan roller, said second drive transmission system being constituted of a second driving gear coaxially provided with said first driving gear, a first intermediate gear meshing with said second driving gear, a second intermediate gear meshing with said first intermediate gear, and a second driven gear meshing with said second intermediate gear and coaxially provided with said capstan roller.

13. A conveying device for a recording paper according to claim 11, wherein said drive transmission systems consist of a first drive transmission system, a second drive transmission system and a third transmission system, said first drive transmission system being constituted of a first driving gear rotated by said motor and a first driven gear meshing with said first driving gear and coaxially provided with said capstan roller, said second drive transmission system being constituted of a second driving gear coaxially provided with said first driving gear, a first intermediate gear meshing with said second driving gear, a second intermediate gear meshing with said first intermediate gear, and a second driven gear meshing with said second intermediate gear and coaxially provided with said capstan roller, said third transmission system having similar constitution to that of said first drive transmission system.

14. A conveying device for a recording paper according to claim 11, wherein said drive transmission systems comprise:

a first drive transmission system; and a second drive transmission system;

said first drive transmission system comprising:

a first driving gear rotated by said motor; and a first driven gear meshing with said first driving gear and coaxially provided with said capstan roller;

said second drive transmission system comprising:

a second driving gear rotated by said motor; and a second driven gear meshing with said second driving gear and coaxially provided with said capstan roller.

15. A conveying device for a recording paper, comprising:

a motor;

a capstan roller rotated by said motor; and a rotatable pinch roller pressing said capstan roller, said capstan roller and said pinch roller nipping said recording paper and conveying said recording paper in accordance with a rotation of said capstan roller; and a plurality of drive transmission systems for transmitting a drive force of said motor to said capstan roller, each of said drive transmission systems having the same reduction ratio as each other; and wherein said drive transmission systems comprise:

a first drive transmission system;

a second drive transmission system; and a third transmission system;

said first drive transmission system comprising:

a first driving gear rotated by said motor; and a first driven gear meshing with said first driving gear and coaxially provided with said capstan roller;

said second drive transmission system comprising:

a second driving gear coaxially provided with said first driving gear;

a first intermediate gear meshing with said second driving gear;

a second intermediate gear meshing with said first intermediate gear; and a second driven gear meshing with said second intermediate gear and coaxially provided with said capstan roller;

said third transmission system comprising:

a third driving gear coaxially provided with said first driving gear; and a third intermediate gear meshing with said third driving gear;

a fourth intermediate gear meshing with said third intermediate gear; and a third driven gear meshing with said fourth intermediate gear and coaxially provided with said capstan roller.

16. A conveying device for a recording paper according to claims 11 or 15, wherein said first intermediate gear and said second intermediate gear have a similar diameter.

* * * * *